US009500458B2

(12) United States Patent
Wigg et al.

(10) Patent No.: US 9,500,458 B2
(45) Date of Patent: Nov. 22, 2016

(54) ELECTRONICALLY ACTIVATED HAND GRENADE

(71) Applicant: Scicast International, Inc., Bechtelsville, PA (US)

(72) Inventors: Martin E. Wigg, North Wales, PA (US); Henry C. Leipert, Jr., East Norriton, PA (US); James H. Elder, Green lane, PA (US)

(73) Assignee: SciCast International, Inc., Bechtelsville, PA (US)

( * ) Notice: Subject to any disclaimer, the term of this patent is extended or adjusted under 35 U.S.C. 154(b) by 0 days.

(21) Appl. No.: 14/677,499

(22) Filed: Apr. 2, 2015

(65) Prior Publication Data

US 2015/0292848 A1 Oct. 15, 2015

Related U.S. Application Data

(60) Provisional application No. 61/977,848, filed on Apr. 10, 2014.

(51) Int. Cl.
*F42C 15/40* (2006.01)
*F42C 11/00* (2006.01)

(52) U.S. Cl.
CPC ..... *F42C 15/40* (2013.01); *F42C 11/003* (2013.01)

(58) Field of Classification Search
CPC ..... F42B 27/00; F42C 15/40; F42C 14/02–14/025; F42C 11/003
USPC ..... 102/487, 488
See application file for complete search history.

(56) References Cited

U.S. PATENT DOCUMENTS

| | | | | |
|---|---|---|---|---|
| 3,712,218 | A * | 1/1973 | Fay | F42C 11/003 102/216 |
| 4,013,012 | A * | 3/1977 | Giattino | F42C 15/40 102/216 |
| 4,066,019 | A * | 1/1978 | Mehnert | F42B 12/20 102/207 |
| 4,677,913 | A * | 7/1987 | Farace | F42C 15/40 102/215 |
| 6,295,931 | B1 * | 10/2001 | Cutler | F42C 13/08 102/221 |
| 6,295,932 | B1 * | 10/2001 | Kane, III | F42C 15/40 102/215 |
| 6,622,629 | B2 * | 9/2003 | Hodge | F42C 15/40 102/215 |
| 6,761,117 | B1 * | 7/2004 | Benz | F42B 12/365 102/482 |
| 7,191,707 | B1 * | 3/2007 | Davis | F42B 6/00 102/237 |
| 8,113,689 | B2 * | 2/2012 | Mayo | F42B 12/36 102/367 |
| 8,522,682 | B1 * | 9/2013 | Genson | F42B 12/10 102/221 |
| 8,887,640 | B1 * | 11/2014 | Knight | F42C 14/025 102/210 |

* cited by examiner

*Primary Examiner* — Troy Chambers
*Assistant Examiner* — Joshua Semick
(74) *Attorney, Agent, or Firm* — Panitch Schwarze Belisario & Nadel LLP

(57) ABSTRACT

An electronic hand grenade is provided, which includes a body having at least one charge therein. An electronic detonation unit is attached to the body for detonating the at least one charge. A pull pin is removably attached to the electronic detonation unit, for activating the electronic detonation unit upon removal thereof. The electronic detonation unit includes an accelerometer for detecting movement and acceleration of the body, a controller containing an operating program for controlling operation of the electronic detonation unit, a detonator for providing a spark to ignite the at least one charge, and a power source for powering the electronic detonation unit.

11 Claims, 4 Drawing Sheets

ELECTRONICALLY ACTIVATED HAND GRENADE

CROSS-REFERENCE TO RELATED APPLICATIONS

This application claims priority to U.S. Provisional Patent Application No. 61/977,848, filed on Apr. 10, 2014, entitled "Electronically Activated Hand Grenade," the entire contents of which are incorporated by reference herein.

BACKGROUND OF THE INVENTION

The present invention is generally directed to a hand grenade, and, more particularly, to an electronically activated hand grenade.

Conventional hand grenades 10, as shown in FIGS. 1 and 2, comprise a body 12, typically fabricated of steel or some other metal, having a main charge 14 and a detonator 16 therein. A chemical delay element or fuse 18 is attached to the detonator 16. A primer 20 is located adjacent an end of the chemical delay element 18, opposite from the detonator 16. A spring loaded handle 22 is pivotably attached to the body 12, and a pin 26, engaged with the body 12 and the handle 22, maintains the handle 22 in a first position (FIG. 1) in which the grenade 10 is deactivated. When the pin 26 is removed, the handle 22 is biased toward a second position (FIG. 2), in which the grenade 10 is activated. However, a user holds the grenade 10 with the handle 22 in the first position until the grenade 10 is thrown.

In use, a user, e.g., a soldier, pulls the pin 26 out of engagement with the body 12 and the handle 22, while manually grasping the grenade 10 and maintaining the handle 22 in the first position. Once the handle 22 moves to the second position, e.g., when a user releases the handle 22 while throwing the grenade 10 after removing the pin 26, a striker 28 underneath the handle 22 rotates and strikes the primer 20. A flash of heat from the primer 20 ignites the chemical delay element/fuse 18. The chemical delay element 18 burns down to the detonator 16 within the main charge 14, creating a chemical spark which set off the main charge 14 within the grenade 10 in a well-known manner. Generally, the chemical delay element 18 should burn down to the detonator 16 and the main charge 14 to set off the grenade 10 in approximately 3 to 5 seconds, giving the user adequate time to throw the grenade 10 a safe distance.

One disadvantage of such conventional grenades 10 is that the exact delay time that the chemical delay element/fuse 18 provides is not precise, and is sometimes unpredictable. Accordingly, if the grenade 10 does not detonate fast enough, the enemy may have an opportunity to pick up the hand grenade 10 and throw it away or back toward the initial user, leading to injury or death of at least the initial user. Another disadvantage of such conventional hand grenades 10 is that if the hand grenade 10 is inadvertently not thrown far enough, the hand grenade 10, upon detonation, could potentially injure or kill at least the user who threw the hand grenade 10.

Therefore, it would be advantageous to manufacture an improved hand grenade providing a more precise detonation structure and procedure, ensuring that the hand grenade detonates at the proper time, while also preventing detonation of the hand grenade if the hand grenade has not traveled far enough away from the user.

BRIEF SUMMARY OF THE INVENTION

Briefly stated, one aspect of the present invention is directed to an electronic hand grenade, which includes a body having at least one charge therein. An electronic detonation unit is attached to the body for detonating the at least one charge. A pull pin is removably attached to the electronic detonation unit, for activating the electronic detonation unit upon removal thereof.

Another aspect of the present invention is directed to a method of detonating an electronic hand grenade including a body having at least one charge therein, an electronic detonation unit attached to the body, including an accelerometer, a controller and a detonator, and a pull pin removably connected to the electronic detonation unit. The method comprises the steps of removing the pull pin to activate the electronic detonation unit, detecting acceleration of the body in at least one of X, Y and Z directions via the accelerometer and determining by the controller whether acceleration has been detected by the accelerometer.

If acceleration has been detected, the controller determines whether the acceleration corresponds to throwing or rolling. If the detected acceleration corresponds to throwing, the controller determines whether the body has been subjected to an impact. If the body is subjected to an impact, the controller determines whether the body has traveled at least a minimum safe throwing distance. If the body has traveled at least the minimum safe throwing distance, the controller instructs the detonator to detonate the at least one charge and the at least one charge is detonated. If the detected acceleration corresponds to rolling, the controller determines whether the body has traveled at least a minimum safe rolling distance. If the body has traveled the at least minimum safe rolling distance, the controller instructs the detonator to detonate the at least one charge, and the at least one charge is detonated.

BRIEF DESCRIPTION OF THE DRAWINGS

The following detailed description of a preferred embodiment of the invention will be better understood when read in conjunction with the appended drawings. It should be understood, however, that the disclosure is not limited to the precise arrangements and instrumentalities shown. In the drawings.

DETAILED DESCRIPTION OF THE INVENTION

Figure 1:
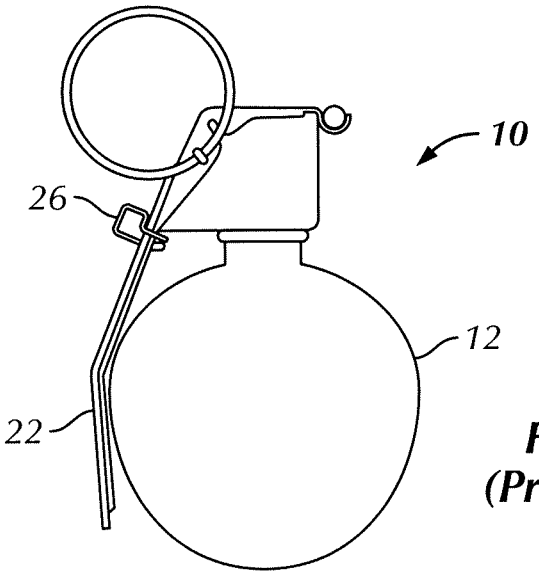
FIG. 1 (Prior Art)
FIG. 1 is a side elevational view of a conventional hand grenade having a chemical delay element in accordance with the prior art.
Figure 2:
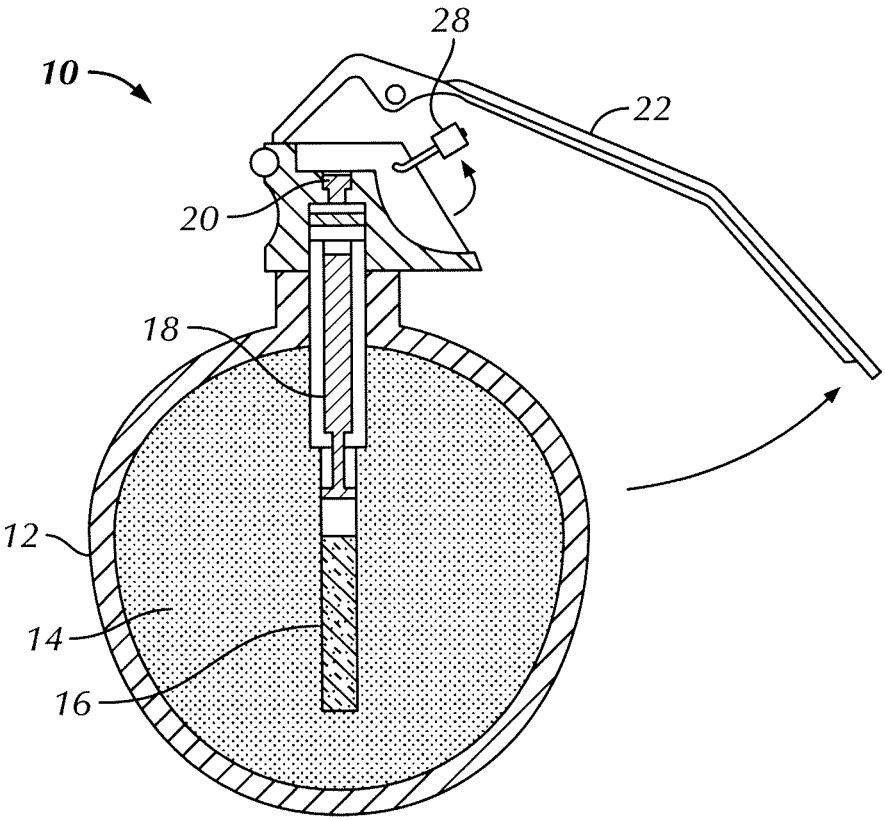
FIG. 2 (Prior Art)
FIG. 2 is a cross-sectional elevational view of the conventional hand grenade of FIG. 1.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the hand grenade, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 3:
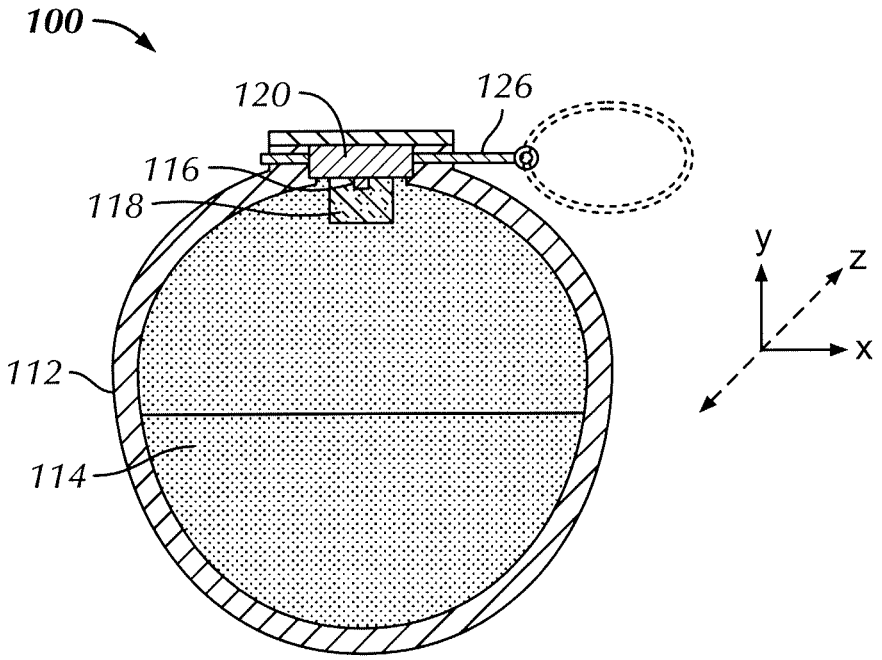
FIG. 3 is a cross-sectional elevational view of an electronically controlled hand grenade, according to a preferred embodiment of the invention.
Figure 4:
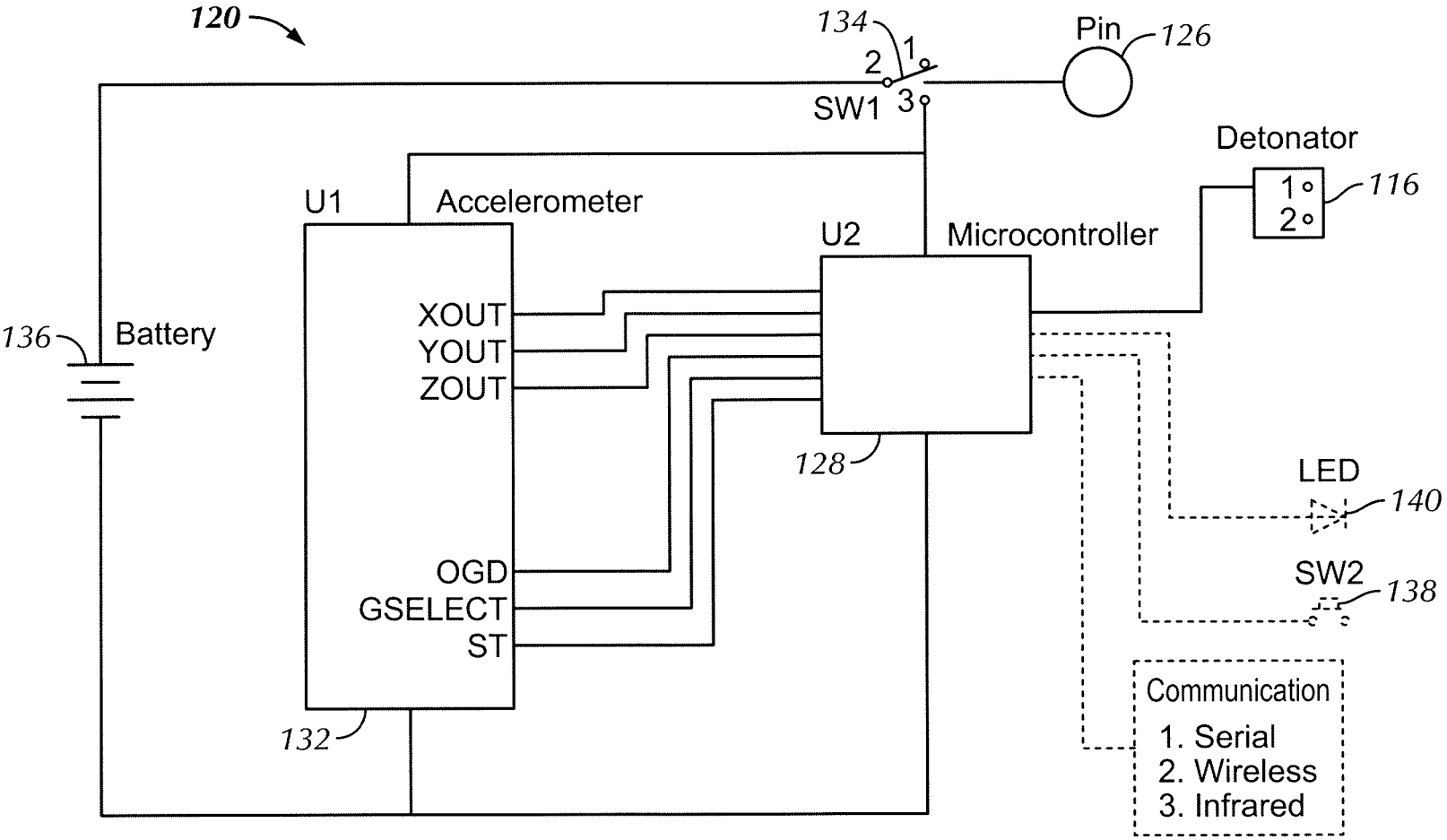
FIG. 4 is a schematic block diagram of an electronic detonation unit of the hand grenade of FIG. 3, which determines detonation of the hand grenade.
Figure 5:
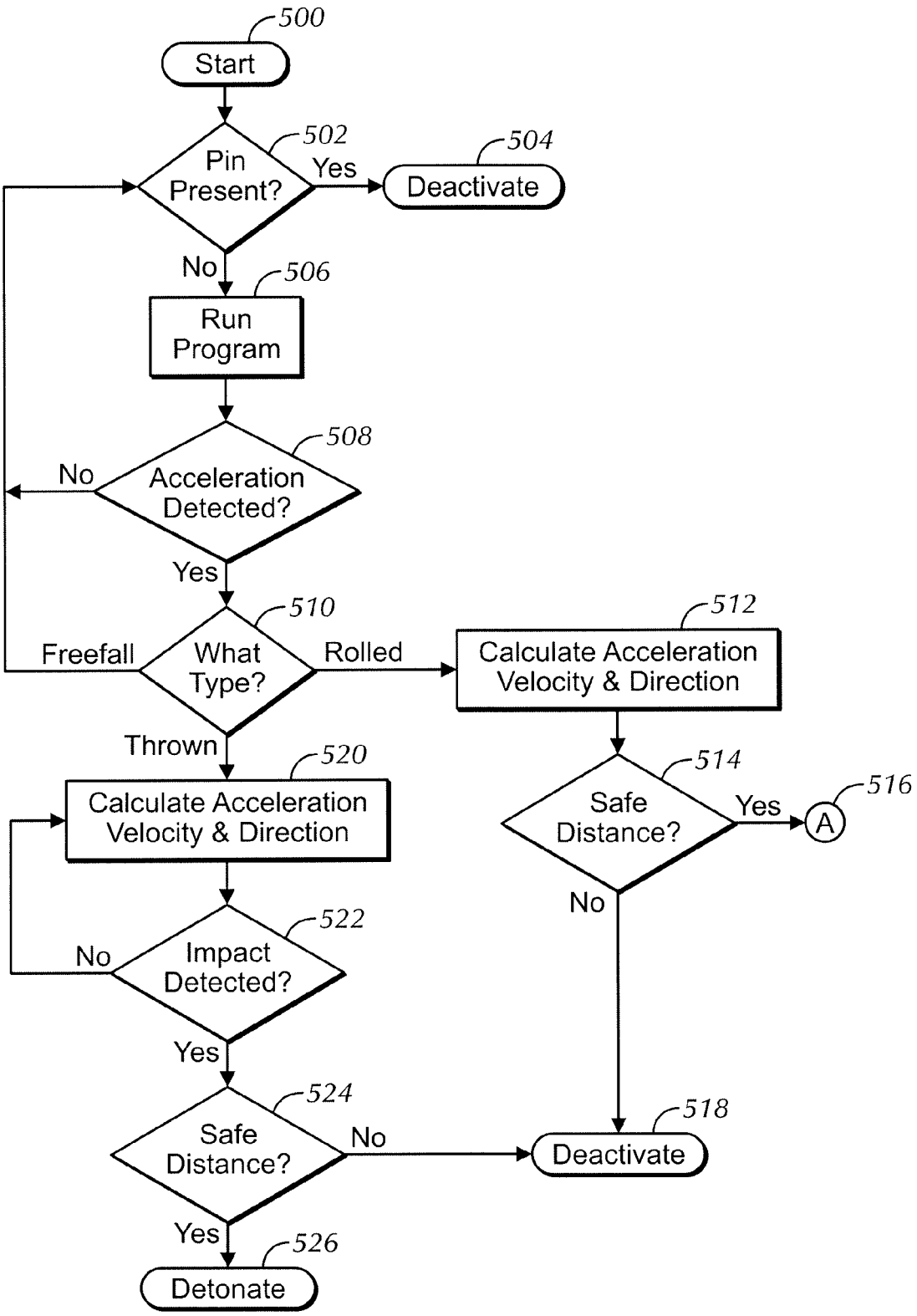
FIG. 5 is a flow diagram depicting the major operational steps of the electronic detonation unit of FIG. 4.

Referring to the drawings in detail, wherein like numerals indicate like elements throughout, there is shown in FIGS. 3-5 a hand grenade, generally designated 100, having an electronic detonation unit or electronically controlled fuse, according to a preferred embodiment of the present invention. As shown in FIG. 3, the hand grenade 100 comprises a body 112, having a main charge 114, and a primary charge 118 therein. The body 112 is substantially the same size and shape as the prior art hand grenade 10 and the main charge 114 is substantially the same as the main charge 14 of the prior art hand grenade 10. An electronic detonation unit 120 is attached to an upper portion of the body 112 and operatively connected to the primary charge 118, and a pull pin 126 similar to the pin 26 of the prior art hand grenade 10 is operatively connected to the electronic detonation unit 120. Removal of the pull pin 126 activates the electronic detonation unit 120, as described further below.

As shown in FIG. 4, the electronic detonation unit 120 includes a logic circuit 128, e.g., a microcontroller, with memory containing an operating program for the electronic detonation unit 120, connected with an accelerometer 132, a detonator 116, which is operatively connected to the primary charge 118, and a power source 136 to power the electronic detonation unit 120, which in the preferred embodiment is a battery. In a preferred embodiment, the battery 136 is a button battery. However, as should be understood by those of ordinary skill in the art, other battery forms or some other power source may alternatively be utilized. As also should be understood by those of ordinary skill in the art, the accelerometer 132 detects movement and acceleration and the detonator 116, e.g. a spark or bridgewire detonator, provides a spark to ignite the primary charge 118, which in turn ignites the main charge 114, in a manner well know by those of ordinary skill in the art.

When the pin 126 is engaged with the electronic detonation unit 120, the electronic detonation unit 120 and thus the hand grenade 100 is not activated. When a user pulls the pin 126 out of engagement with the electronic detonation unit 120, a spring loaded switch 134 is closed, to connect two opposing poles of the electronic detonation unit 120 (poles 2 and 3 in FIG. 4) to thereby apply power from the battery 136 to the accelerometer 132 and the microcontroller 128, to activate the microcontroller 128 and the accelerometer 132. When the hand grenade 100 moves, i.e., is thrown or rolled, the accelerometer 132 detects acceleration in the X, Y, and Z directions (as shown in the coordinate system of FIG. 3) and continuously or periodically outputs the detected data $X_{out}$, $Y_{out}$, and $Z_{out}$ to the microcontroller 128 in a manner well known in the art. Alternatively, the acceleration data could be output with a serial, or some other, protocol. If the hand grenade 100 is dropped, and thus freely accelerates under the force of gravity in the Z direction, the accelerometer 132 outputs detected data OGD, identifying such motion.

The microcontroller 128 calculates the velocity and direction of travel of the thrown or rolled hand grenade 100, in a manner well understood by those of ordinary skill in the art. The microcontroller 128 also detects time of flight, e.g., via a counter or other such device, in a manner well known by those of ordinary skill in the art. With the calculated velocity, direction and time of flight, the microcontroller 128 continuously or periodically calculates the distance the hand grenade has traveled from the user during flight or rolling movement. When the hand grenade 100 stops, such as for example by hitting the ground, an impulse acceleration is detected. As should be understood by those of ordinary skill in the art, alternative devices for calculating velocity, distance and impact, currently known, or that later become known, may be utilized.

In operation, as shown in the flow diagram of FIG. 5, when the electronic detonation unit 120 is activated, i.e., power applied (500), the microcontroller 128 first checks to confirm whether the pin 126 is present (502) in the electronic detonation unit 120. If the pin 126 is present, an anomaly is detected and the electronic detonation unit 120 is deactivated (504). No action is taken by the microcontroller 128 if the pin 126 remains in engagement with the electronic detonation unit 120. Under normal conditions, however, when the pin 126 has been pulled out of engagement with the electronic detonation unit 120, i.e., the pin 126 is not present, operation of the microcontroller 128 continues (506) and the microcontroller 128 repeatedly checks whether the data detected by the accelerometer 132 and received by the microcontroller 128 (508) indicates the presence of acceleration (indicating that the hand grenade 100 has been thrown or rolled). If no acceleration is detected by the accelerometer 132, the microcontroller 128 makes no further calculations, but merely cycles back through a repetitive feedback loop until acceleration is detected.

Detected acceleration may be of multiple types. For example, if the hand grenade 100 is thrown in a normal manner, the accelerometer 132 detects a short rapid acceleration, likely in all of the X, Y and Z directions, followed by a period of zero acceleration while the hand grenade 100 is in flight. Impulse acceleration, i.e., impact, is detected once the microcontroller 128 determines an immediate deceleration or complete stop, indicating that the thrown hand grenade 100 has reached its destination. As another example, if the hand grenade 100 is dropped, i.e., free fall, the accelerometer 132 detects acceleration primarily only in the vertical Z direction, followed by an immediate impulse detection, i.e., an immediate stop, indicating that the hand grenade 100 has hit the ground. As yet another example, if the hand grenade 100 is rolled, the accelerometer detects acceleration primarily only in the X and Y directions.

Thus, once the acceleration data collected by the accelerometer 132 is sent to the microcontroller 128, the microcontroller 128 determines what type of motion the hand grenade 100 has been subjected to (510). If the microcontroller 128 determines that the hand grenade 100 has been subjected to free fall, e.g., the hand grenade 100 has been dropped, the detonator 116 is not activated. Rather, the microcontroller 128 cycles back through the repetitive feedback loop until another form of acceleration is detected (508). Accordingly, if a hand grenade 100 is inadvertently dropped by a user after the pin 126 has been removed, the hand grenade 100 does not detonate and injure or kill the user. Additionally, the user has an opportunity to pick up the hand grenade 100 and either replace the pin 126 or throw/roll the hand grenade 100 as initially intended.

If the microcontroller 128 determines that the hand grenade 100 has been thrown (520), the microcontroller 128 also determines when an impact is detected (522). So long as an impact is not detected, the microcontroller 128 cycles back to assess additional data sent by the accelerometer 132. Once impact is detected (522) (indicating the hand grenade 100 has reached its destination), the microcontroller 128 determines, based on calculated velocity and flight time, whether the hand grenade 100 has traveled a minimum safe distance (524). A minimum safe distance is generally defined by the "wounding radius," i.e., the distance at which detonation of the hand grenade 100 will not injure the user. For example, when the hand grenade 100 is thrown, a typical minimum threshold value for safe distance may be approximately about 15 meters (49 feet). However, as should be understood by those of ordinary skill in the art, the microcontroller 128 may be programmed with any desired distance, which the manufacturer determines is the safe distance.

If the microcontroller 128 determines that the hand grenade 100 has traveled a safe distance, the microcontroller 128 instructs the detonator 116 to detonate immediately (526). The detonator element 116 thus immediately ignites the primary and main charges 118, 114, thereby exploding the hand grenade 100. Thus, there is no opportunity for the enemy to pick up and throw the hand grenade. Conversely, even if impact is detected, if the microcontroller 128 determines that the hand grenade 100 has not traveled the safe distance, the microcontroller 128 deactivates the hand grenade 100 (518). Accordingly, the hand grenade 100 does not injure or kill the user who initially threw the hand grenade. Deactivating the hand grenade 100 also ensures that even if the enemy locates and throws the hand grenade 100, that it will not detonate.

Alternatively, if the microcontroller 128 determines that the hand grenade 100 has been rolled (512), e.g., if a soldier rolls the hand grenade 100 into a room, the microcontroller 128 determines whether a safe distance has been traveled (514). The safe distance when the hand grenade 100 is rolled may or may not be the same safe distance when the hand grenade 100 is thrown. For example, the safe distance when a hand grenade 100 is rolled may be less than the safe distance when the hand grenade 100 is thrown. Once the microcontroller 128 determines that a safe distance for a rolling hand grenade 100 has been traveled, the microcontroller 128 operates in accordance with a programmed instruction (FIG. 5, A) (516). For example, the microcontroller 128 may instruct the detonator 116 to detonate immediately once the hand grenade 100 stops. Alternatively, the microcontroller 128 may instruct the detonator 116 to detonate once the hand grenade 100 is picked up, i.e., acceleration is again detected. Conversely, if the microcontroller 128 determines that the hand grenade 100 has stopped without traveling the minimum safe distance, then the hand grenade 100 is deactivated (518). Thus, if the hand grenade 100 does not travel a safe distance, it does not detonate, thereby minimizing the chance of injuring or killing the user who initially rolled it. Additionally, even if an enemy rolls or throws the hand grenade 100 back at the initial user, it does not detonate, as it has been deactivated.

Thus, one advantage of the hand grenade 100 is that the microcontroller 128 is programmed to not detonate, or alternatively to deactivate, if the pin 126 is inadvertently removed, or if under an abnormal circumstance, the microcontroller 128 is activated prior to removal of the pin 126. If the pin 126 is removed or the hand grenade 100 is dropped accidentally, the microcontroller 128 detects abnormal acceleration, not corresponding to throwing or rolling, and does not activate the hand grenade 100. Thus, the hand grenade 100 remains safe, allowing the pin 126 to be replaced.

Another advantage of the hand grenade 100 is that if the hand grenade 100 is thrown short, the microcontroller 128 determines, based on the data received from the accelerometer 132, that the hand grenade 100 has not traveled a minimum safe distance. The microcontroller 128 is deactivated, and, therefore, does not activate the detonator 116. Yet another advantage of the hand grenade 100 is that it may be easily used with both the left or right hands.

As should be understood by those of ordinary skill in the art, the microcontroller 128 may be programmed with additional modes of operation and safety features. The microcontroller 128 may also be wirelessly reprogrammed in the field, using a serial interface, wireless communication, infrared signal or any other suitable means of communication, as shown in phantom in FIG. 4. Further, the hand grenade 100 may be detonated remotely via one or more of such connections.

Further, the hand grenade 100 may also include a time delay ignition. As shown in FIG. 4, the hand grenade 100 may optionally include a spring loaded button 138 operatively connected to the microcontroller 128, via, for example, connection switch SW2 (shown in phantom). After removal of the pin 126, if the button 138 is depressed and held down for a predetermined time, a counter or other indicator within the microcontroller 128 is activated and instructs the detonator 116 to detonate once the counter or other indicator times out. The hand grenade 100 may optionally further include a light 140 (FIG. 4), e.g., an LED light, that flashes once time delay ignition is activated. The light 140 may also flash at an increasing rate up to the time of detonation.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the disclosure.

We claim:

1. A method of detonating an electronic hand grenade including a body having at least one charge therein; an electronic detonation unit attached to the body, including an accelerometer, a controller and a detonator; and a pull pin removably connected to the electronic detonation unit, the method comprising:

removing the pull pin to activate the electronic detonation unit;

detecting acceleration of the body in at least one of X, Y and Z directions via the accelerometer;

determining by the controller whether acceleration has been detected by the accelerometer;

if acceleration has been detected, determining by the controller whether the acceleration corresponds to throwing or rolling of the body; and wherein, if the detected acceleration corresponds to throwing:

determining by the controller whether the body has been subjected to an impact;

if the body is subjected to an impact, determining by the controller whether the body has traveled at least a minimum safe throwing distance; and if the body has traveled at least the minimum safe throwing distance, instructing by the controller, the detonator to detonate the at least one charge; and detonating the at least one charge; or wherein, if the detected acceleration corresponds to rolling:

determining by the controller whether the body has traveled at least a minimum safe rolling distance; and if the body has traveled the at least minimum safe rolling distance, instructing by the controller, the detonator to detonate the at least one charge; and detonating the at least one charge.

2. The method according to claim 1, further comprising the steps of:

checking, via the controller, whether the pin is present in the electronic detonation unit; and if the pin is present, deactivating the electronic detonation unit.

3. The method according to claim 1, further comprising repeating the step of determining whether acceleration has been detected by the accelerometer, until the controller determines that acceleration has been detected.

4. The method according to claim 1, wherein the step of determining by the controller whether the acceleration corresponds to throwing or rolling further comprises determining by the controller whether the acceleration corresponds to dropping the body; and if the detected acceleration corresponds to dropping the body, then returning to the step of determining whether acceleration has been detected by the accelerometer.

5. The method according to claim 4, wherein the step of determining, by the controller, whether the acceleration corresponds to throwing, rolling or dropping comprises determining, by the controller, whether acceleration is present in one or more of the X, Y and Z directions, wherein acceleration in substantially all of the X, Y and Z directions corresponds to throwing, acceleration in substantially only the X and Y directions corresponds to rolling, and acceleration in substantially only the Y direction corresponds to dropping.

6. The method according to claim 1, wherein the step of determining, by the controller, whether the body has been subjected to an impact comprises:

detecting substantial deceleration or stop of the body via the accelerometer; and determining, by the controller, whether the substantial deceleration or stop follows acceleration detection.

7. The method according to claim 1, further comprising the step of counting time of motion of the body by a counter of the controller, and wherein the step of determining whether the body has traveled the minimum safe throwing distance comprises:

calculating, by the controller, velocity and flight time of the body;

calculating, by the controller, distance traveled by the body according to the calculated velocity and flight time; and evaluating, by the controller, whether the distance traveled is greater than the minimum safe throwing distance.

8. The method according to claim 1, further comprising the step of counting time of motion of the body by a counter of the controller, and wherein the step of determining whether the body has traveled the minimum safe rolling distance comprises:

calculating, by the controller, velocity and flight time of the body;

calculating, by the controller, distance traveled by the body according to the calculated velocity and flight time; and evaluating, by the controller, whether the distance traveled is greater than the minimum safe rolling distance.

9. The method according to claim 1, wherein, if the body has not traveled the minimum safe throwing or rolling distances, further comprising the step of deactivating the electronic detonation unit.

10. The method according to claim 1, wherein the step of detonating the body if the acceleration corresponds to rolling comprises detonating the body upon detecting subsequent acceleration via the accelerometer.

11. The method according to claim 1, wherein the hand grenade further comprises a time-activating button operatively connected to the controller, and further comprising the steps of:

depressing the time-activating button to activate a timer of the controller set to a predetermined countdown time; and overriding the steps of claim 1 and detonating the body when the timer times out.

* * * * *